US010881932B2

(12) United States Patent
Burns

(10) Patent No.: US 10,881,932 B2
(45) Date of Patent: Jan. 5, 2021

(54) TOSSING PROJECTILE TARGET GAME

(71) Applicant: EastPoint Sports Ltd., LLC, Succasunna, NJ (US)

(72) Inventor: James P. Burns, Cranford, NJ (US)

(73) Assignee: EastPoint Sports Ltd., LLC, Succasunna, NJ (US)

( * ) Notice: Subject to any disclaimer, the term of this patent is extended or adjusted under 35 U.S.C. 154(b) by 0 days.

(21) Appl. No.: 16/829,315

(22) Filed: Mar. 25, 2020

(65) Prior Publication Data

US 2020/0306603 A1 Oct. 1, 2020

Related U.S. Application Data

(60) Provisional application No. 62/825,780, filed on Mar. 28, 2019.

(51) Int. Cl.
*A63B 63/00* (2006.01)
*A63B 67/06* (2006.01)

(52) U.S. Cl.
CPC ..... *A63B 63/00* (2013.01); *A63B 67/06* (2013.01); *A63B 2210/50* (2013.01)

(58) Field of Classification Search
CPC ... A63B 2063/065; A63B 63/00; A63B 63/06; A63B 2067/063; A63B 67/066; A63B 67/06; A63B 2210/50
USPC ..... 273/398–402, 348
See application file for complete search history.

(56) References Cited

U.S. PATENT DOCUMENTS 1,942,280 A 1/1934 Fohmann
2,170,850 A 8/1939 Bonnett et al.
2,247,852 A * 7/1941 Saunders ..... A63B 63/083 273/412
2,508,527 A 5/1950 Martin et al.
2,690,787 A 10/1954 Soltis
D192,148 S 1/1962 Brodie
3,554,550 A * 1/1971 Schram ..... A63B 67/06 273/388
3,814,359 A 6/1974 Powell
4,487,419 A 12/1984 Welbourn
D285,396 S 9/1986 Odate
D288,828 S 3/1987 Romestan et al.
4,715,600 A 12/1987 Offutt
4,796,762 A 1/1989 Law
4,938,485 A 7/1990 Hockridge et al.
4,943,065 A 7/1990 Delapa
4,961,586 A 10/1990 Conville
4,982,966 A 1/1991 Teafatiller
5,056,796 A 10/1991 Conville
(Continued)

OTHER PUBLICATIONS

Eastpoint Sports, Ltd., LLC—Light-Up Ladderbail Assembly Video, Published Mar. 14, 2018 https://www.youtube.com/watch?v=-OAXP-XcU5M, YouTube, USA.

(Continued)

*Primary Examiner* — John E Simms, Jr.
*Assistant Examiner* — Rayshun K Peng
(74) *Attorney, Agent, or Firm* — Shane Delsman; Godfrey & Kahn, S.C.

(57) ABSTRACT

A target projectile tossing game including a frame, a horizontal support connected to the frame, and a target coupled to the horizontal support. The target may be sized to receive the projectile therein and may further be configured to rotate relative to the frame based on force from the tossed projectile.

19 Claims, 3 Drawing Sheets

(56) References Cited

U.S. PATENT DOCUMENTS

| | | | | |
|---|---|---|---|---|
| 5,165,695 | A | 11/1992 | Yoder | |
| 5,201,527 | A | 4/1993 | Koket | |
| 5,224,699 | A | 7/1993 | Zaruba | |
| D340,082 | S | 10/1993 | Delapa | |
| 5,333,879 | A | 8/1994 | Barnes | |
| D363,953 | S | 11/1995 | Buse | |
| D375,530 | S | 11/1996 | Rudd | |
| 5,678,824 | A | 10/1997 | Fortier et al. | |
| 5,827,136 | A | 10/1998 | Halter et al. | |
| 5,871,216 | A | 2/1999 | Sparacino | |
| 5,882,010 | A | 3/1999 | Geror | |
| D408,462 | S | 4/1999 | Frycz | |
| 5,909,877 | A | 6/1999 | Bour | |
| 5,954,337 | A * | 9/1999 | Cunningham | A63B 67/06 273/338 |
| D428,061 | S | 7/2000 | Billodeau et al. | |
| 6,158,593 | A | 12/2000 | Olsen | |
| D438,910 | S | 3/2001 | Culberson | |
| 6,244,598 | B1 | 6/2001 | Conville | |
| 6,308,956 | B1 | 10/2001 | Reid | |
| 6,435,512 | B1 | 8/2002 | Beckwith, Sr. | |
| D474,246 | S | 5/2003 | Carr | |
| D478,357 | S | 8/2003 | Penna | |
| D478,939 | S | 8/2003 | McReynolds | |
| D479,279 | S | 9/2003 | Kessler, Jr. et al. | |
| 6,773,014 | B2 | 8/2004 | Lynch | |
| 6,780,129 | B1 * | 8/2004 | Higuchi | A63B 63/08 273/378 |
| 6,808,175 | B1 | 10/2004 | Gleeson | |
| 6,837,809 | B2 | 1/2005 | Majumdar | |
| 6,880,828 | B2 | 4/2005 | Liao | |
| 6,889,982 | B1 | 5/2005 | Gove | |
| 6,923,448 | B2 | 8/2005 | Fairbanks | |
| 6,932,345 | B1 | 8/2005 | O'Dell et al. | |
| 7,201,676 | B2 | 4/2007 | Rumfola, III | |
| D544,041 | S | 6/2007 | Murphy et al. | |
| D545,911 | S | 7/2007 | Verni | |
| 7,237,777 | B2 | 7/2007 | Digges, III et al. | |
| 7,328,902 | B1 | 2/2008 | White et al. | |
| 7,377,516 | B2 | 5/2008 | Vallee et al. | |
| D576,685 | S | 9/2008 | Queally | |
| 7,500,674 | B2 | 3/2009 | Riley et al. | |
| D591,358 | S | 4/2009 | Moore | |
| 7,607,666 | B1 | 10/2009 | Studier | |
| 7,703,771 | B2 | 4/2010 | Hunt et al. | |
| D621,881 | S | 8/2010 | Youngberg et al. | |
| 7,802,795 | B2 | 9/2010 | Bos | |
| D626,181 | S | 10/2010 | Lima | |
| 7,887,059 | B2 | 2/2011 | Kiernan | |
| D635,196 | S | 3/2011 | Voden | |
| D635,197 | S | 3/2011 | Pryor | |
| 7,959,154 | B2 | 6/2011 | Ball | |
| D645,520 | S | 9/2011 | Dahl | |
| D646,334 | S | 10/2011 | Ingram | |
| D649,601 | S | 11/2011 | Buchanan | |
| 8,127,689 | B2 | 3/2012 | Christian et al. | |
| 8,128,093 | B1 | 3/2012 | Gerrish | |
| 8,157,265 | B2 | 4/2012 | Conville et al. | |
| 8,162,318 | B1 | 4/2012 | Peterson et al. | |
| 8,387,934 | B2 | 3/2013 | Nally et al. | |
| 8,657,293 | B2 | 2/2014 | Sindaco | |
| D706,355 | S | 6/2014 | Montenare | |
| D748,198 | S | 1/2016 | Nally | |
| D781,960 | S | 3/2017 | Czwalga | |
| D806,171 | S | 12/2017 | Nally | |
| 2002/0079645 | A1 | 6/2002 | Brown | |
| 2003/0221347 | A1 * | 12/2003 | Peterson | G09F 21/04 40/593 |
| 2004/0058756 | A1 | 3/2004 | Huang | |
| 2005/0051968 | A1 | 3/2005 | Froesel | |
| 2005/0269784 | A1 | 12/2005 | Peters | |
| 2006/0022409 | A1 | 2/2006 | Zimmermann | |
| 2006/0125184 | A1 | 6/2006 | Benson | |
| 2007/0080499 | A1 | 4/2007 | Greiwe et al. | |
| 2007/0257438 | A1 | 11/2007 | Deal | |
| 2008/0042360 | A1 | 2/2008 | Veikley | |
| 2008/0048397 | A1 | 2/2008 | Mancini | |
| 2008/0220913 | A1 | 9/2008 | Cosenza | |
| 2008/0237990 | A1 | 10/2008 | Litz | |
| 2009/0048040 | A1 | 2/2009 | Tribulato | |
| 2009/0111588 | A1 | 4/2009 | Sudeck et al. | |
| 2009/0115136 | A1 | 5/2009 | Voden | |
| 2010/0275641 | A1 | 11/2010 | Manner et al. | |
| 2011/0037226 | A1 | 2/2011 | Nickles | |
| 2011/0092319 | A1 | 4/2011 | Gurgul et al. | |
| 2011/0291361 | A1 | 12/2011 | Moeller et al. | |
| 2012/0043723 | A1 | 2/2012 | Rakes | |
| 2014/0265136 | A1 * | 9/2014 | Parker | A63B 67/002 273/398 |

OTHER PUBLICATIONS

Eastpoint Sports, Ltd., LLC—Go! Gater® Folding Ladderball—Assembly Video, Published May 19, 2017 https://www.youtube.com/watch?v=dyBa2U7gvr4, YouTube, USA.

Eastpoint Sports, Ltd., LLC—EastPoint® Sports Bean Bag Toss / Tic Tac Toss—Assembly Video, Published Apr. 14, 2017 https://www.youtube.com/watch?v=I4PtAt0as3g, YouTube, USA.

The Grommet—Bean Bag Bucketz Bean Bag Basket Toss Game, Published Mar. 22, 2017 https://www.youtube.com/watch?v=wkWdbZkMOYA, YouTube, USA.

Office Playground, Inc. "Nerf Basketball Hoop—Nerfoop"; website http://officeplayground.com/Ner-Basketball-Hoop-Nerfoop-P352.aspx; p. 1.

* cited by examiner

TOSSING PROJECTILE TARGET GAME

PRIORITY CLAIM AND CROSS-REFERENCE TO RELATED APPLICATION

This application is based on and claims priority to U.S. Provisional Patent Application No. 62/825,780, filed on Mar. 28, 2019, which is incorporated herein by reference in its entirety for all purposes.

FIELD

The present disclosure relates generally to the field of games. More particularly, the present disclosure relates to a projectile target game.

BRIEF DESCRIPTION OF THE DRAWINGS

Embodiments of the tossing projectile target game are disclosed with reference to the accompanying exemplary drawings, which are for illustrative purposes. It will be understood by those skilled in the art that one or more aspects of this invention can meet certain objectives, while one or more other aspects can lead to certain other objectives. Other objects, features, benefits and advantages of the present invention will be apparent in the summary and descriptions of the disclosed embodiment(s), and will be readily apparent to those skilled in the art. Such objects, features, benefits and advantages will be apparent from the above as taken in conjunction with the accompanying figures and all reasonable inferences to be drawn therefrom.

DETAILED DESCRIPTION

Figure 1:
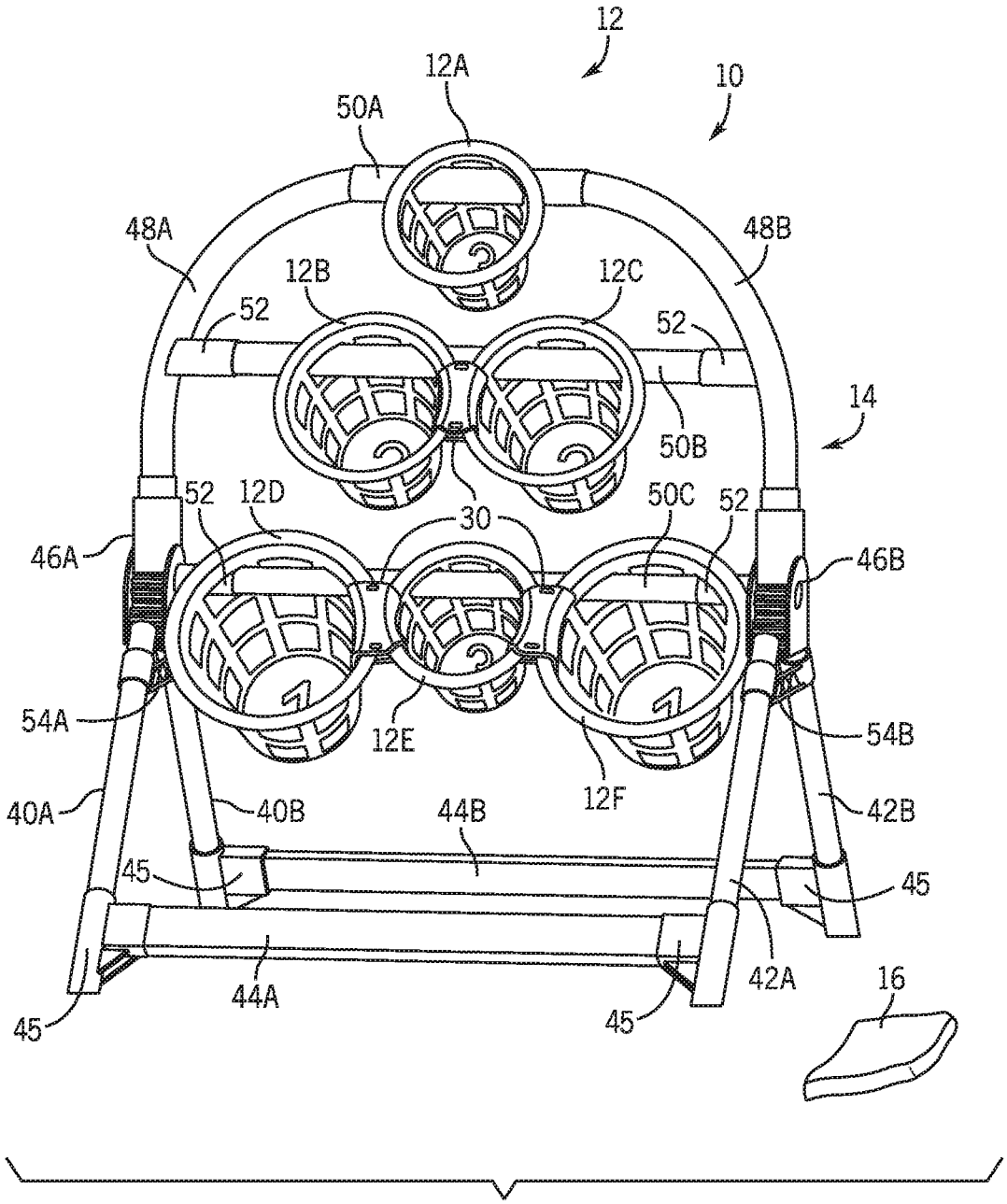
FIG. 1 is a front perspective view of a target structure, according to one embodiment of the present disclosure.
Figure 2:
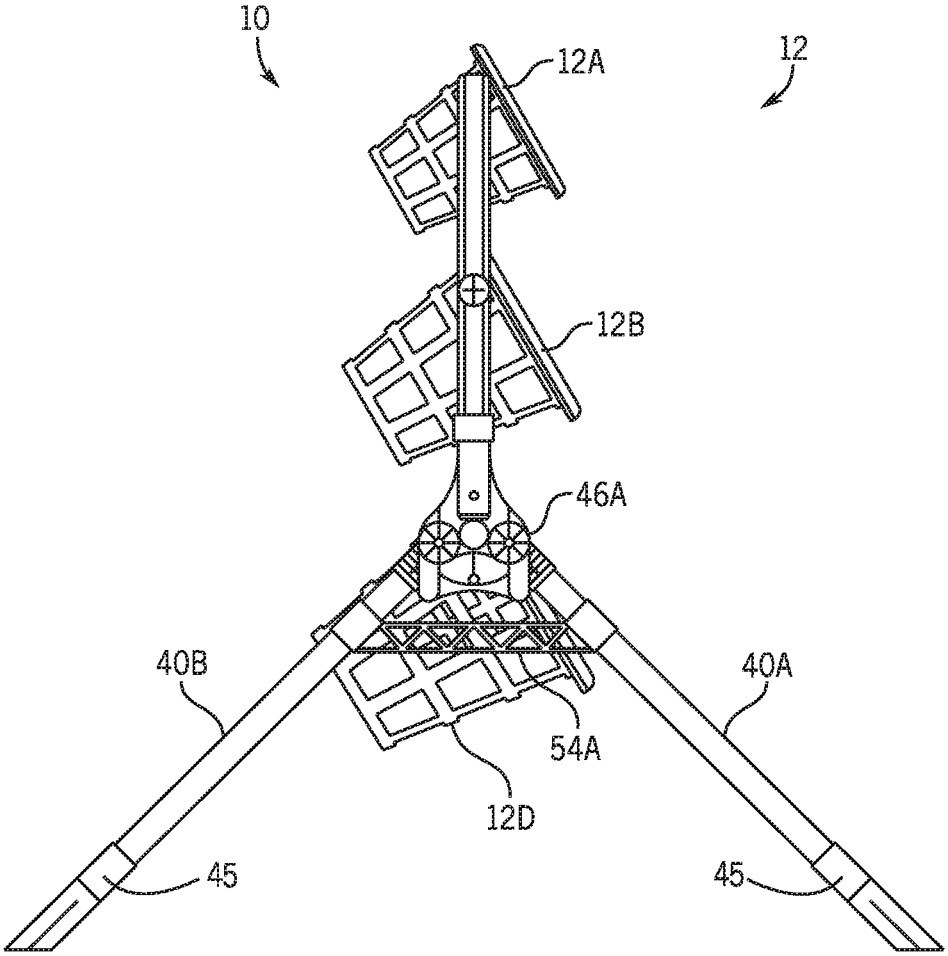
FIG. 2 is a side elevation view of the target structure of FIG. 1.

FIGS. 1 and 2 are views of a target structure 10, generally including a plurality of targets 12 (e.g., targets 12A-12F) coupled to a support frame or support assembly 14. The target structure 10 may be used as part of a game in which a player tosses a projectile 16 (e.g., a bean bag, ball, or other item) toward the target structure 10. If the projectile 16 lands in any of the plurality of targets 12, that player may receive an advantage, e.g. points being awarded, for landing the projectile within the particular target.

Figure 3:
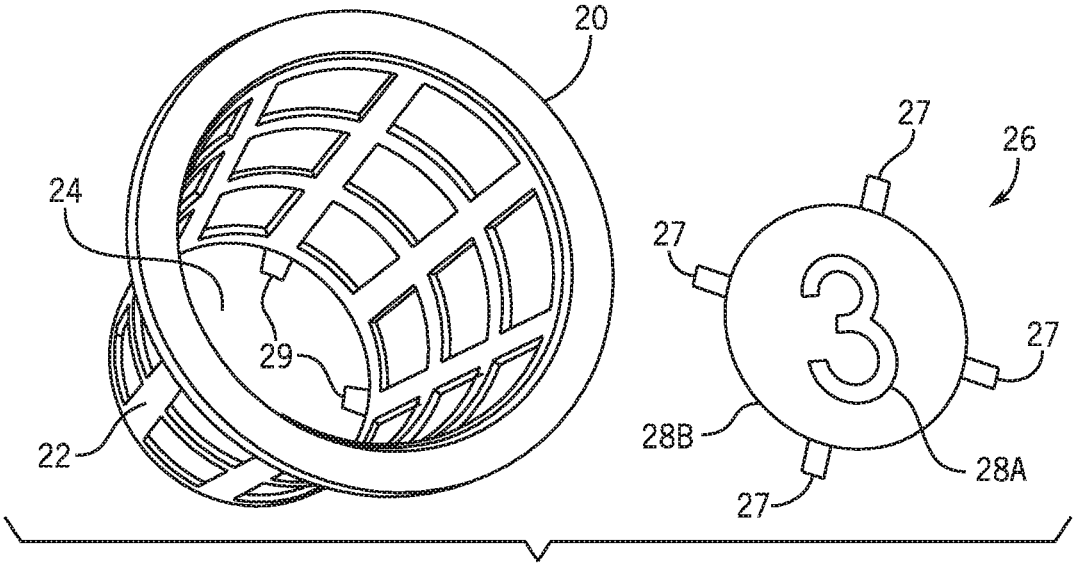
FIG. 3 is an exploded perspective view of one of the targets shown in FIG. 1.

As illustrated and with further reference to FIG. 3, the targets 12 may be formed of a basket that includes a top rim 20, a sidewall 22, and a bottom 24. During game play, a player may try to toss a projectile through an opening in the rim 20 in order to score points. If the projectile lands and stays on the bottom 24 of the target 12, points may be awarded to the player tossing the projectile. In the embodiment shown, the top rim 20 is generally circular, the sidewall 22 is shaped as a tapered cylinder, and the bottom 24 is formed of a plate or similar structure. In other embodiments, other shapes and configurations for the targets 12 can be used, including a rectangular outer shape for the opening, sidewall and/or bottom. In the present embodiment, the sidewall is formed of a lattice-type structure having both vertical and horizontal members or supports crossing over one another to form the sidewall. The lattice-type structure of the sidewall may lower the material costs of constructing each basket, compared to a basket having a solid sidewall structure. Further, in some embodiments, the gaps formed in the lattice-type structure may be sized to permit a user to readily observe which baskets contain projectiles and which do not at a given point in game play. In other embodiments, the sidewall can be formed of a solid structure or other type of structural element extending from the bottom to the top opening. While, in this embodiment, the bottom 24 is a generally closed, solid surface, in other embodiments, the material forming the bottom 24 may also form openings, for instance, similar to the lattice openings of sidewall 22, the remaining material being of sufficient size and width to contain a projectile 16 landed in the target 12 during gameplay.

Other examples for target 12 include, but are not limited to, pails, bags, nets and other structures sized to hold the projectile. In certain embodiments, the targets 12 may vary in comparative size, and points may vary accordingly. For instance, with reference to FIG. 1, targets 12A and 12E are comparatively smaller in size to the other targets, the rim 20 forming a narrower opening for capturing a projectile 16, and thus, in this embodiment, targets 12A and 12E are assigned a higher comparative point value. In contrast, targets 12D and 12F are comparatively larger in size, the rim 20 forming a wider opening for capturing a projectile 16, and therefore, in this embodiment, targets 12D and 12F are assigned a lower comparative point value.

A marker 26, which may include an indicia portion 28A and a plate portion 28B, can be secured to the bottom 24. In some embodiments, the indicia portion 28A may indicate a number of points to be added to a player or a team score for landing a projectile in that particular target 12. In other embodiments, the indicia portion 28A may indicate another form of instruction, such as a direction to throw an additional projectile or to lose a turn. In one embodiment, the indicia portion 28A may be printed onto the plate portion 28B, for example, by screen printing. The marker 26 may be secured to the bottom 24 in a number of different ways, for example, using an adhesive, a hook and loop mechanism, ultrasonic welding, snap fit, press fit, interference fit, and other ways. In other embodiments, rather than utilizing a discrete scoring marker 26, a scoring indicia may be directly printed onto the bottom 24 or sidewall 22 of the target 12. In certain embodiments, a plurality of tabs 27, as shown in FIG. 3, can be positioned within corresponding recesses 29 proximate the bottom 24 and configured to hold the scoring marker 26 in place within the target 12, removably attaching the marker 26 to the bottom 24. Using a readily and selectively attachable and detachable method of attachment may permit the points associated with various targets 12 to be varied between games for different game play experiences.

The support frame 14 may be formed of a plurality of structural members that may support one or a plurality of the targets 12, as well as withstand force generated by the projectiles striking the plurality of targets 12, and/or support frame 14. The support frame 14 may be made of various types of materials and/or structural members to both provide support to the plurality of targets 12 and withstand force generated by projectiles striking the plurality of targets 12 and/or frame 14. In one embodiment, the structural members are formed of polyvinyl chloride (PVC), which is a lightweight, yet durable plastic. Other materials known in the industry may also be utilized, for instance, wood, metal, and other plastics. The structural members can generally extend vertically to locate the plurality of targets 12 above a ground surface and horizontally to support the plurality of targets 12, including in side-by-side relationship.

In the illustrated embodiment, as seen in FIGS. 1-2, the support frame 14 includes a base including a first pair of support legs 40A, 40B positioned on one side of the frame 14 and a second pair of support legs 42A, 42B positioned on an opposite side of the frame 14. Legs 40A and 42A may be coupled together with a horizontal support member 44A, whereas legs 40B and 42B may be coupled together with a horizontal support member 44B. The horizontal support members 44A, 44B could be attached to the first pair of support legs 40A, 40B or second pair of support legs 42A, 42B by brackets 45. The brackets 45 may have openings to receive the support legs and/or horizontal support members as seen in FIG. 1, or the brackets 45 may have posts that are received in openings in the support legs and/or horizontal support members. Other means are known for attaching components of a frame, e.g. integrally forming, fasteners, etc., the use of which would not defeat the spirit of the invention.

Triangular support bracket 46A may connect legs 40A and 40B. In a similar manner, triangular support bracket 46B may connect legs 42A and 42B. In some embodiments, the support bracket 46, may permit rotation of 40A and 42A towards legs 40B and 42B, permitting the support frame 14 to collapse into a generally flat structure. This allows the frame to be shipped and/or sold in a smaller box which in turn results in less shipping costs and less shelf space for storage and sale. Bracket 46A may further connect with a vertical support member 48A. Likewise, bracket 46B may further connect with a vertical support member 48B, vertical support members 48A and 48B forming a main frame of the support assembly 14. The brackets 46A, 46B may have posts that receive or are received by the support legs 40A, 40B, 42A, 42B and/or support members 48A, 48B. A brace 54A, 54B could also be used to further support the frame, such as, for example, between corresponding support legs 40A, 40B and 42A, 42B, as seen in FIGS. 1-2. Such braces 54A, 54B could have one end that is slid onto one of the supporting legs 40A or 42A and then snapped onto the other supporting leg 40B or 42B once the brace is slid into place.

A plurality of horizontal target supports 50A-50C may be provided in the support frame 14, each support 50A-50C extending horizontally to support the plurality of targets 12 at different heights relative to the ground. Target supports 50A and 50B are coupled with vertical support members 48A and 48B, whereas target support 50C is coupled with brackets 46A and 46B. In one embodiment, the support members may include one or more posts 52. The target support can have hollow ends, which receive the posts 52 to attach the target support to the support members. Alternatively, the target supports could be received by the posts 52 or within openings in the support members. Alternatively, or additionally, the hollow ends of the target support 50A could receive an end of the support members 48A, 48B.

In one embodiment, target support 50A supports a single target (12A), target support 50B supports two targets (12B and 12C), and target support 50C supports three targets (12D, 12E and 12F). The arrangement of the plurality of targets 12 is exemplary only, and other arrangements can be provided as desired. For example, in one embodiment two horizontal target supports are provided at different heights, with three different targets coupled with each horizontal target support. In another embodiment, four or more horizontal target supports are provided at different heights, with a different number of targets coupled with each horizontal target support. In yet a further embodiment, a single horizontal target support is provided, with one or more targets coupled with the single horizontal target support.

In one embodiment, the lattice-type structure of the sidewall 22 of the targets 12 may be selected to engage the support frame and may further include openings sized to allow rotation of the targets 12 with respect to the support frame 14. For example, a horizontal support may extend through opening(s) formed in the lattice-type structure, permitting rotation of the target 12 about a longitudinal axis of the horizontal support. Other means of attaching a target to a support are known in the industry, e.g. brackets, hooks, etc., the use of which would not defeat the spirit of the invention. A bracket 30 or other similar structure can be used to secure together two adjacent targets 12, such that adjacent targets rotate with one another. Alternatively, the targets could be fixedly attached to the target support and the target support rotatably attached to the support member, such that the target(s) and target support rotate together in relation to the support member.

Figure 4:
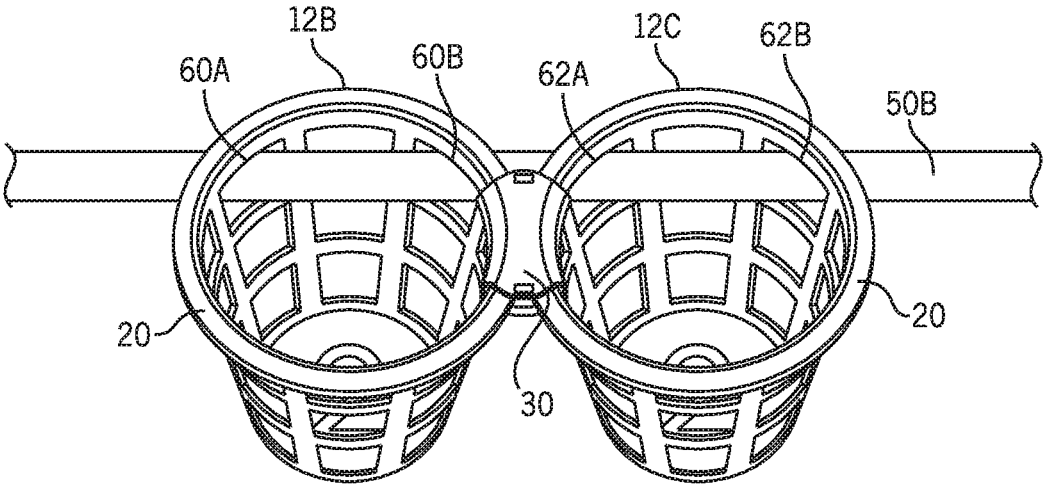
FIG. 4 is a perspective view of a plurality of the targets shown in FIG. 1, coupled together by a bracket.
Figure 5:
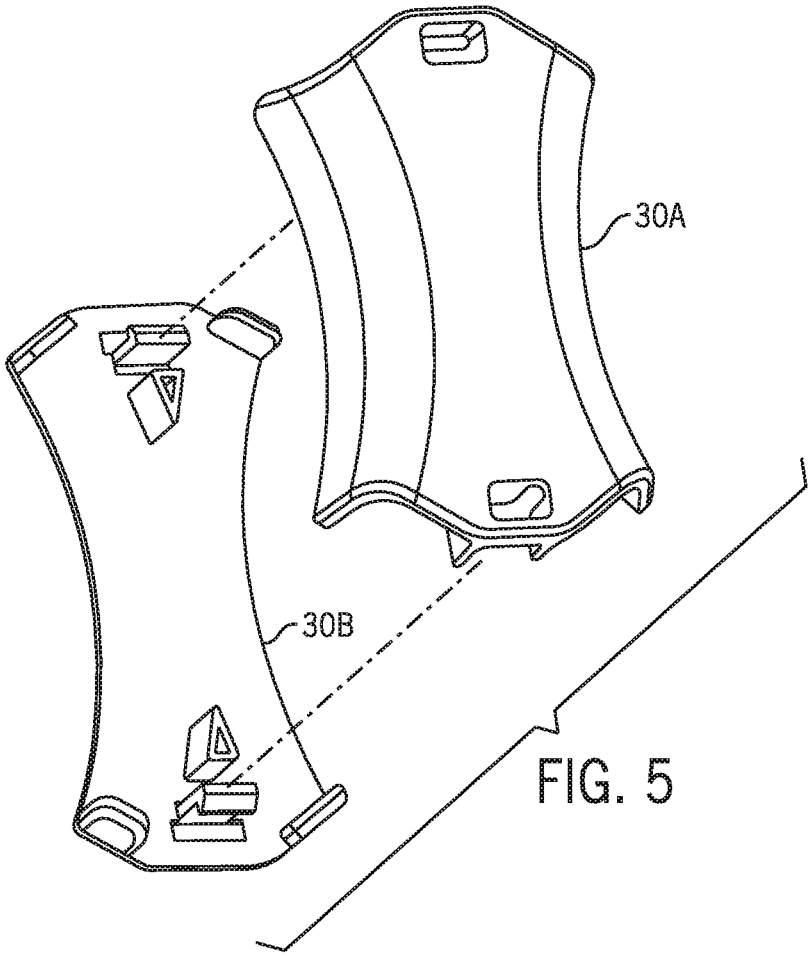
FIG. 5 is an exploded view of a bracket, according to one embodiment of the present disclosure.

With reference to FIG. 4, a horizontal support 50B is illustrated that supports targets 12B and 12C. The horizontal support 50B extends through openings 60A and 60B of target 12B and openings 62A and 62B of target 12C. The openings 60A, 60B, 62A, 62B may be selected such that support 50B is offset from a center of gravity for targets 12B and 12C and the opening in the rim 20 may be oriented towards the players. Accordingly, forces (e.g., from a projectile) placed on at least one of the targets 12B and 12C sufficient to rotate the target, will cause both targets 12B and 12C to, together, rotate about support 50B. Alternatively, targets 12B and 12C could be permitted to rotate independently of one another. In some embodiments, the bracket 30 may be used to secure adjacent targets 12 (e.g., targets 12B and 12C) to one another such that the targets 12 rotate together. With reference to FIG. 5, bracket 30 may include a top half 30A and a bottom half 30B that engage one another with corresponding rims 20 positioned there between, as seen in FIG. 4. Other means of attaching two targets together are known in the industry, e.g. integrally forming, fasteners, glue, hooks and loops, etc., the use of which would not defeat the spirit of the invention.

During play, in one embodiment, projectiles 16 (e.g., bean bags) are tossed in sequential order toward the plurality of targets 12. In some embodiments, the projectiles 16 may be tossed by players from two different teams. For example, each team may have the opportunity to toss four bean bags per round toward the plurality of targets 12 in alternating order. After a round, any bean bags remaining in the targets 12 will cause points to be awarded to the team that tossed the bean bags. While the round is ongoing, due to the fact that at least some of the targets 12 are rotatable with respect to the respective longitudinal axes of target supports members 50A-50C, bean bags can fall out of higher rotatable targets and fall to the ground (causing no points to be awarded) or to a different target, positioned closer to the ground. For example, for a bean bag positioned within target 12A, a subsequent bean bag hitting target 12A may cause axial rotation of the target 12A with respect to horizontal support 50A such that the opening faces a generally downward direction sufficient to allow the bean bag present in the target 12A to fall from target 12A. Thus, gravity may cause the bean bag initially thrown into the target 12A to fall into any of the lower targets 12B-12F, which may cause the points awarded for that round to be changed. Alternatively, the bean bag may fall to the ground, causing no points to be awarded to the bean bag that was initially thrown into the target 12A. Other methods of scoring may further be employed.

Although the invention has been herein described in what is perceived to be the most practical and preferred embodiments, it is to be understood that the invention is not intended to be limited to the specific embodiments set forth above. Rather, it is recognized that modifications may be made by one of skill in the art of the invention without departing from the spirit or intent of the invention and, therefore, the invention is to be taken as including all reasonable equivalents to the subject matter of the appended claims and the description of the invention herein.

What is claimed is:

1. A target structure, comprising:

a support frame, including:

a base;

at least one vertical support attached to the base; and a horizontal support coupled to the at least one vertical support; and a first target rotatably coupled to the frame; and a second target rotatably coupled to the frame;

wherein the first target and second target are configured to be rotatable about a longitudinal axis of the horizontal support;

wherein the first target and second target are configured to receive a tossed projectile; and wherein the first target is attached to the second target such that when the first target rotates the second target rotates.

2. The target structure of claim 1, wherein the first target is a basket having a top rim with an opening formed therein, a sidewall, and a bottom.

3. The target structure of claim 2, wherein the horizontal support is positioned through an opening formed in the sidewall of the first target.

4. The target structure of claim 2, further comprising a marker connected to the first basket, indicating an instruction associated with the first basket.

5. The target structure of claim 4, wherein the instruction includes a point value.

6. The target structure of claim 4, wherein the marker is removably attached to the bottom of the first basket.

7. The target structure of claim 6, wherein the bottom of the first basket forms a plurality of recesses and the marker includes a plurality of tabs and wherein each of the plurality of tabs are received in corresponding ones of the plurality of recesses when the marker is positioned adjacent to the bottom of the first basket.

8. The target structure of claim 2, wherein the first target is configured to axially rotate when the second target axially rotates.

9. A target game, comprising:

a plurality of projectiles; and a support assembly, comprising:

a main frame;

a first horizontal member connected to the main frame at a first height;

a second horizontal member connected to the main frame at a second height;

a first target rotatably connected to the first horizontal member; and a second target connected to the second horizontal member;

wherein the first target and second target are configured to receive at least one of the plurality of projectiles;

wherein the first target is configured to rotate upon one of the plurality of projectiles hitting the first target;

wherein the first height is above the second height; and wherein the first target is located above the second target such that when the first target has received a first one of the plurality of projectiles and a second one of the plurality of projectiles hits the first target such that the first target rotates, the first one of the plurality of projectiles will fall out of the first target and be received in the second target.

10. The target game of claim 9, wherein the first target is a first size and the second target is a second size, and wherein the first size is different than the second size.

11. The target game of claim 9, further comprising:

a third horizontal member connected to the main frame;

a third target connected to the third horizontal member; and wherein a number of targets attached to the second horizontal member is greater than a number of targets attached to the third horizontal member.

12. The target game of claim 11, wherein the third horizontal member is positioned above the second horizontal member.

13. The target game of claim 9, further comprising a third target rotatably connected to the first horizontal member and wherein the first target and third target are connected to one another such that the third target rotates about the at least one horizontal member when the first target rotates.

14. A method of playing a game, comprising:

positioning a support frame having a first target positioned at a first height and second target positioned at a second height, wherein the second height is different from the first height;

tossing a plurality of projectiles toward the support frame;

landing one of the plurality projectiles within the first target;

hitting the first target with a second one of the plurality of projectiles such that the first target rotates with respect to the support frame; and awarding a score based on a number of the plurality of projectiles being landed within the first target and second target;

wherein when the step of hitting the first target occurs after the step of landing the at least one of the plurality of projectiles within the first target, the rotation of the first target is sufficient to cause the at least one of the plurality of projectiles in the first target to be removed from the first target.

15. The method of claim 14, wherein the at least one of the plurality of projectiles being removed from the first target further comprises the projectile landing within the second target.

16. The target game of claim 9, wherein the first target has a bottom opposite a top and wherein the top has an opening formed therein;

wherein the first target may be rotated between a first position and a second position;

wherein the top of the first target s above the bottom in the first position and the top of the first target is below the bottom in the second position; and wherein the first target may be moved between the first position and second position by the second one of the plurality of projectiles hitting the first target.

17. The target game of claim 16, wherein when the first target has received the first one of the plurality of projectiles and the first target is in the second position, the first one of the plurality of projectiles will fall out of the first target and be received in the second target.

18. The target game of claim 16, wherein when the first target is in the second position, the top of the first target is proximate to an opening formed in a top of the second target.

19. The target game of claim 18, wherein when the first target is in the second position, the first one of the plurality of projectiles may move from the first target to the second target.

* * * * *